US007257337B2

(12) United States Patent
Amico

(10) Patent No.: US 7,257,337 B2
(45) Date of Patent: Aug. 14, 2007

(54) FUSER IMAGE STRESS ANALYSIS SYSTEM

(75) Inventor: Mark S. Amico, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 154 days.

(21) Appl. No.: 11/168,876

(22) Filed: Jun. 29, 2005

(65) Prior Publication Data

US 2007/0003298 A1 Jan. 4, 2007

(51) Int. Cl.
*G03G 15/20* (2006.01)

(52) U.S. Cl. ..... 399/33; 399/320
(58) Field of Classification Search ..... 399/24, 399/33, 81, 82, 320
See application file for complete search history.

(56) References Cited

U.S. PATENT DOCUMENTS 6,366,744 B1 * 4/2002 Phillips et al. ..... 399/24

* cited by examiner

*Primary Examiner*—David M. Gray
*Assistant Examiner*—Ryan D. Walsh
(74) *Attorney, Agent, or Firm*—Oliff & Berridge, PLC

(57) ABSTRACT

Exemplary embodiments include systems and methods to operate an image forming apparatus including at least one or more images of an image reproduction job to be performed using the image forming apparatus and an image reproduction device having a useful life consumed by the image forming apparatus in performing the jobs. Exemplary embodiments include determining image information regarding one or more images for at least one image reproduction job; determining, for the image reproduction device, a remaining useful life of the image reproduction device; determining, for at least one job, and based on the remaining useful life of the image reproduction device, if that job can be performed based on the remaining useful life; generating, an alert notification if that job can not be completed in view of the remaining useful life; and conveying the alert notification to a user, wherein the image information includes fuser use information for reproducing the images.

16 Claims, 5 Drawing Sheets

| SCANLINE (SLOW SCAN DIRECTION) | PIXEL LOCATON (FAST SCAN DIRECTION) | | | | | | | | | |
|---|---|---|---|---|---|---|---|---|---|---|
| | 1 | 2 | 3 | 4 | 5 | 6 | 7 | 8 | 9 | N |
| 1 | 0 | 1 | 1 | 1 | 1 | 0 | 1 | 0 | 0 | 1 |
| 2 | 0 | 1 | 1 | 1 | 0 | 0 | 0 | 1 | 1 | 0 |
| 3 | 0 | 0 | 0 | 1 | 1 | 1 | 1 | 1 | 1 | 0 |
| 4 | 0 | 0 | 1 | 1 | 1 | 0 | 1 | 1 | 1 | 0 |
| 5 | 1 | 0 | 1 | 0 | 0 | 1 | 1 | 1 | 0 | 0 |
| 6 | 0 | 1 | 0 | 0 | 0 | 0 | 0 | 1 | 1 | 0 |
| 7 | 0 | 0 | 1 | 0 | 0 | 0 | 1 | 1 | 0 | 1 |
| 8 | 1 | 0 | 0 | 0 | 0 | 1 | 0 | 0 | 0 | 0 |
| 9 | 0 | 0 | 0 | 0 | 0 | 0 | 1 | 0 | 0 | 1 |
| 10 | 0 | 0 | 1 | 0 | 0 | 0 | 1 | 1 | 0 | 0 |
| 11 | 0 | 0 | 0 | 1 | 0 | 1 | 0 | 1 | 1 | 1 |
| 12 | 0 | 1 | 0 | 1 | 0 | 0 | 1 | 1 | 0 | 0 |
| 13 | 1 | 0 | 1 | 1 | 0 | 0 | 1 | 0 | 1 | 1 |
| 14 | 0 | 1 | 1 | 0 | 0 | 0 | 0 | 0 | 1 | 0 |
| 15 | 0 | 0 | 1 | 0 | 0 | 0 | 1 | 0 | 1 | 1 |
| N | 1 | 1 | 1 | 1 | 0 | 1 | 0 | 0 | 1 | 0 |
| | 4 | 6 | 10 | 8 | 3 | 5 | 10 | 9 | 9 | 6 |

*FIG. 3*

FIG. 4A
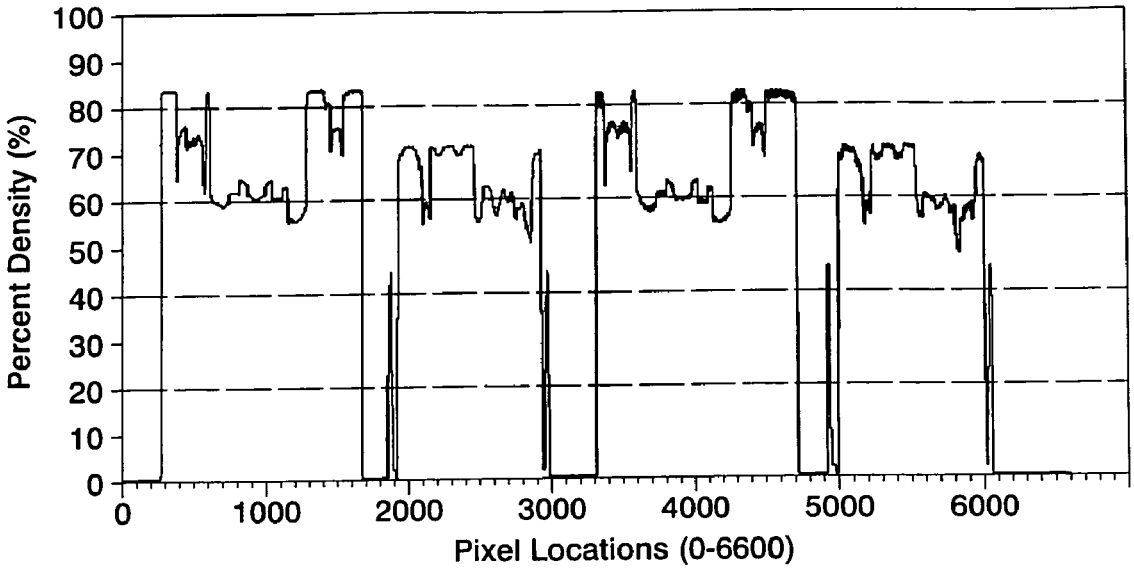
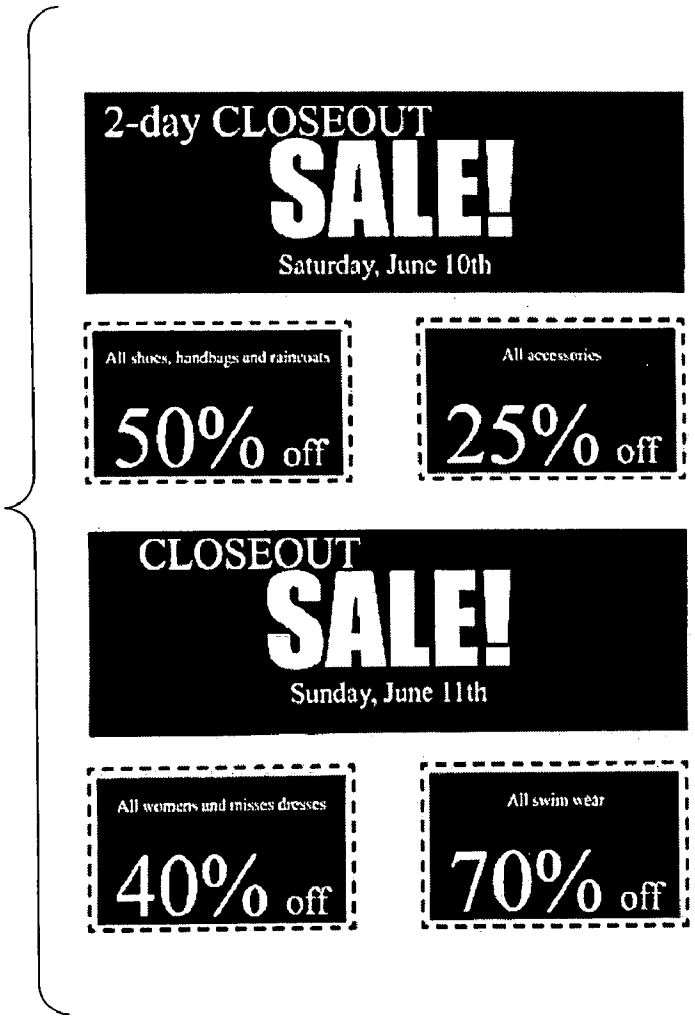
FIG. 4B

FUSER IMAGE STRESS ANALYSIS SYSTEM

BACKGROUND

Exemplary systems and methods described herein relate to performing image stress analysis, such as for a fuser in an image forming device.

Printers, copiers and other types of image forming devices have become ubiquitous office productivity tools for generating tangible copies of original documents and/or electronic documents. Under normal circumstances, a user sends a print request to the image forming system and then retrieves the formed image. Problems may arise when making copies on a recording medium, such as reaching the end of the useful life of one of the integral parts of the image-forming device, such as a fuser. Dealing with these problems results in lower productivity and additional cost to the user and/or customer.

In related art image-forming devices, a light image of an original to be copied is recorded in the form of an electrostatic latent image on a photosensitive member. The latent image can subsequently be rendered visible by the application of toner. The visible toner image is in a loose powdered form and can easily be disturbed or destroyed. The toner image can be fixed or fused with the fuser or fuser roll, upon a support, which may be a photosensitive member itself or other support sheet such as plain paper, transparency, specialty coated paper, or the like.

The related art uses thermal energy for fixing toner images onto the support member. When using the fuser to permanently fuse toner material onto a support surface by heat, it is necessary to elevate the temperature of the toner material to a point at which the constituents of the toner material coalesce and become tacky. This heating causes the toner to flow to some extent into the fibers or pores of the support member. Thereafter, as the toner material cools, solidification of the toner material causes the toner material to be firmly bonded to the support.

SUMMARY

Depending on the image to be reproduced and the amount of toner that is needed to recreate the image, the fusing of that amount of may generate varying amounts of stress on the fuser, that is, high toner densities for forming the image are viewed to represent high local stresses for the fuser. Correspondingly, repeated exposure of the fuser roll surface to consistent high toner inputs without allowing the fuser to recover from the image recently fused will result in a decrease in the useful life of the fuser.

This situation can more clearly be described by comparing two exemplary fusers, i.e., fuser A and fuser B, both utilizing a chemically active release agent. In this example, fuser A is exposed to random images that vary in both the cross-process and process scan directions. Further, this random image pattern allows fuser A time enough to recover chemically from the image recently fused. If fuser A were consistently exposed to these types of images, it would be expected to last a very long time. In contrast, fuser B is presented with toner images in specific areas, of sufficient size in the process scan direction, and fuser B is not allowed to chemically recover. In this situation, fuser B would be expected to fail far sooner than fuser A and thus has a shorter useful life. Accordingly, high toner densities associated with given images to be reproduced, are viewed to represent high local stresses and repeated exposure of the fuser roll to the high stresses will lead to a shorter useful life of the fuser roll.

However, a close approximation of the life expectancy of a fuser roll is extremely difficult to predict due to the close relationship between the requested image reproduction submitted to the fuser and its expected life. As discussed above, a fuser roll will have different life expectancies depending on the images and the number of copies of the images to be reproduced. In the related art, above-described problems are not analyzed before image production begins. As a result, the problems arise during the image production. However, during image production, the user is not aware that printing of the documents did not take place or could not be completed in full because of the exhaustion of the fuser roll. Thus, the user will have to conduct troubleshooting at the image forming system, resulting in costly delays to the user, the company, and/or the customer.

Related art image forming system fuser rolls need to be replaced. However, the unexpected timing and the delays associated with replacement of the fuser roll can be reduced, minimized, or avoided.

It is desirable to extend the life of fuser roll devices to the maximum extent possible. Accordingly, exemplary embodiments address the above discussed and/or other problems and enable users to predict the expected life of a fuser roll and whether the fuser roll will be able to complete the assigned printing job, based on criteria, such as the type and number of images to be reproduced. According to exemplary embodiments, a user can be anyone associated with the image forming system, such as any person who is concerned with the life of the fuser. That is, a user can be field personnel, a technician, a supplier, and/or an engineer.

It is possible to reduce, minimize or eliminate the above problems by determining the toner density areas of an image to be reproduced, providing analysis of any high toner density areas and providing this information to a user. Providing this information to the user in advance of a system fault occurring due to the fuser becoming exhausted or the fuser reaching the end of its useful life during image reproduction, gives the user an early opportunity to add or replace a fuser to avoid delays and maintain productivity.

Additionally, if the user is aware that such a system fault would occur prior to a print request job being completed, the user could manipulate the order of reproduction of any other pending print request jobs, or the customer could eliminate a low value images (ex. Document text borders) all together. In this way, the various jobs in the job queue can be arranged to ensure that the job with the highest priority is completed before the fuser is fully exhausted and/or reaches the end of its useful life.

Exemplary embodiments provide systems and methods for estimating when a fuser is likely to reach the end of its useful life and need replacement.

Exemplary embodiments provide systems and methods that identify the status of the fuser relative to the jobs assigned to that image forming system and for notifying the user when the fuser is likely to need replacement.

In various exemplary embodiments, the programs, systems and methods use fuser surface pixel maps derived from page image toner coverage, to analyze regional stress level transmitted to the fuser roll.

In various other exemplary embodiments, the image forming system's controller can determine whether this image forming system will be able to complete a particular image reproduction job based on analysis of the stress levels that will be transmitted to the fuser.

In various exemplary embodiments, the pixel map and/or the analysis of the pixel map can be incorporated in the image forming system diagnostic and/or control systems.

Thus, the pixel map can be used as a diagnostic tool to help understand fuser life and/or performance issues.

In various exemplary embodiments, if the job is not able to be completed, the image forming system alerts the user that the job cannot be completed. This allows the user to adjust the image to be printed in a way to reduce the stress applied to the fuser or to replace the fuser so that the print job can be completed.

These and other features and advantages are described in or are apparent from the following detailed description of various exemplary embodiments.

BRIEF DESCRIPTION OF THE DRAWINGS

Various exemplary embodiments of the systems and methods will be described in detail, with reference to the following figures, wherein:

FIG. 3 is a schematic showing a pixel map corresponding to a scanned image according to exemplary embodiments;

FIGS. 4A and 4B show a percent density of toner hits with respect to fuser pixel map for a scanned image;

DETAILED DESCRIPTION OF EMBODIMENTS

The following description of various exemplary embodiments of the toner fusing and image stress level analysis systems and methods according to exemplary embodiments may refer to and/or illustrate one or more specific types of toner fusing unit for, e.g., an image forming device for the sake of ease of definition and description, clarity and familiarity. However, it should be appreciated that the principles of exemplary embodiments, as outlined and/or discussed below, can be equally applied to any known or later-developed toner fusing system that employs heat and pressure to fuse toner particles onto or into the image bearing surface of an image receiving medium on which toner particles were previously deposited to form an image in an image forming device.

Exemplary image forming devices include, but are not limited to, printers, copiers, facsimile machines, multifunction image production and reproduction devices, xerographic devices and any other like device or unit in which images are produced or reproduced on image bearing surfaces of image receiving mediums using toner particles which are fused onto or into the image bearing surface of an image receiving medium by at least one of being melted and heated and pressed onto or into the image bearing surface of an image receiving medium in an image forming device.

It should be appreciated that, although discussed below and depicted in the figures as substantially a heat pipe or a heated/heatable fuser roller, the systems and methods according to exemplary embodiments are not limited to such an application, but rather can be applied equally to any heatable fuser member currently available, or reasonably contemplated for use, in an image forming device. As such, this disclosure is directed to a heatable fuser member and this term will be deemed as encompassing all contemplated embodiments thereof which may include, but are not limited to, rollers, belts, or other like heated/heatable fuser devices usable to fuse dry toner onto or into image bearing surfaces of image receiving mediums in exemplary image forming devices.

Figure 1:
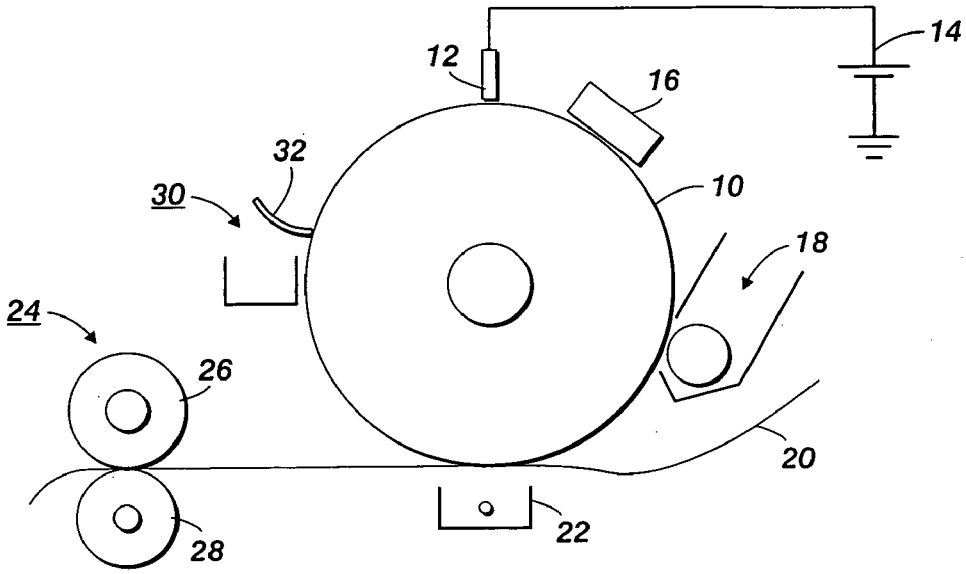
FIG. 1 is a schematic showing an imaging apparatus including a fuser member in the form of a fuser roll.

FIG. 1 is a schematic showing an imaging apparatus. A light image of an original to be copied is recorded as an electrostatic latent image on a photosensitive member, such as a photoreceptor 10. The latent image is rendered visible by the application of toner to the photoreceptor 10. Specifically, photoreceptor 10 is charged on its surface by a charger 12 to which a voltage has been supplied from power supply 14. The photoreceptor 10 is then exposed to light emitted by a light source 16 to form an electrostatic latent image on the photoreceptor 10. Alternatively, as is known in the art, the latent image can be digitally formed on the photoreceptor 10. The electrostatic latent image is developed with toner at a development station 18.

After the toner particles have been deposited on the photoreceptor 10, in image configuration, they are transferred to a copy sheet 20 by a transfer device 22. The transfer process can be, for example, a pressure transfer or electrostatic transfer process. Alternatively, the developed image can be transferred to an intermediate transfer member and subsequently transferred to a copy sheet.

After the transfer of the developed image is completed, copy sheet 20 advances to a fusing station 24 including a fuser member and a pressure member. According to exemplary embodiments, the fusing station 24 includes a hot roll-fusing device to provide the heated pressing surface usable to melt and press the toner onto or into the image-bearing surface of the image-receiving medium. In this embodiment, the fuser member and pressure member comprise a fuser roll 26 and a pressure roll 28. At the fusing station 24, the developed image is fused to copy sheet 20 by passing the copy sheet 20 between the fusing roll 26 and the pressure member 28, thereby forming a permanent image. The photoreceptor 10 is then advanced to a cleaning station 30. The cleaning station 30 cleans the photoreceptor 10 to remove residual toner from the photoreceptor 10 by use of a cleaning device, such as blade 32.

Figure 2:
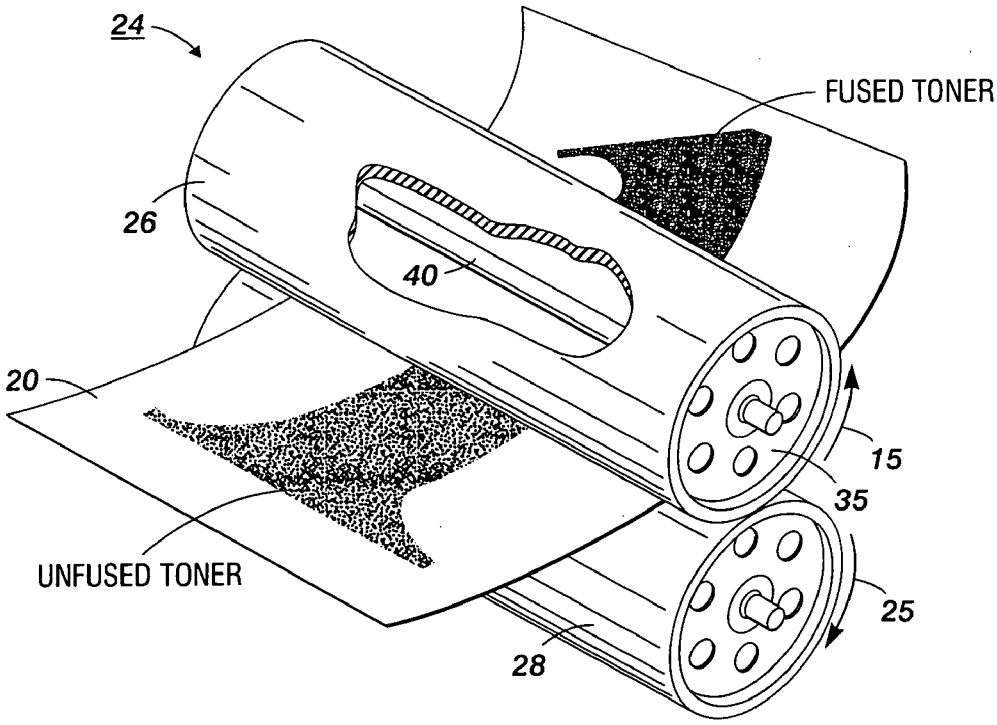
FIG. 2 is a schematic showing a fuser roll according to exemplary embodiments.

As shown in FIG. 2, the hot roll fusing device 24 includes a heated fuser roller 26 and an opposing pressure roller 28, the two rollers 26, 28 rotating respectively in directions depicted by arrows 15 and 25. The heated fuser roller 26 can be formed of a hollow tube with a cylindrical surface 30 which may be closed at the ends with end caps 35 which may have vent holes as depicted. The heated fuser roller 26 contains a heat source in the form of a heating element 40.

Heating element 40, usable to heat the cylindrical surface 30 of the heated fuser roller 26, can be, for example, quartz rods or lamps. The construction of the heated fuser roller 26 is to conduct heat generated in the heating element 40 through the cylindrical surface 30 of the heated fuser roller 26 to the copy sheet or receiving medium 20 in order that toner, previously deposited on the image bearing surface of the image receiving medium 20, can be melted and pressed and therefore fused thereon.

In order to further facilitate the fusing process in the hot roll fusing device 24, the second element of pressure is added, to supplement the first element of heat applied through the cylindrical surface of the heated fuser roller 26, with inclusion of the pressure roller 28 that opposes the heated fuser roller 26. The heated and pressure roller surfaces results in an increased exposure of any given point on the receiving medium 20 to the heat and pressure generated in the hot roll fusing device 24 by the contact on either side of the receiving medium 20 of the pressure roller 28 and the opposing heated fuser roller 26. The pressure facilitates heating and pressing of the toner to melt and press, and thereby fuse the toner onto or into the image-bearing surface. Accordingly, the systems described above facilitate fusing of toner on image receiving mediums 20 by melting the toner and simultaneously forcing the melted toner into the image-bearing surface of the image receiving mediums 20.

The fuser members according to exemplary embodiments can have different configurations and sizes. For example, fuser members can be formed as fuser rolls and fuser belts. However, the term "fuser" or "fuser roll" as used herein also refers to other different configurations, such as films, sheets and the like; donor members, including donor rolls, belts, films, sheets and the like; pressure members, including pressure rolls, belts, films, sheets and the like; and other members useful in fusing systems of electrostatographic imaging apparatus. The fusers of exemplary embodiments can be used in various different machines and their use is not limited to those embodiments depicted and described herein.

FIG. 3 is a schematic showing an example of histogram data showing the number of pixel hits for a corresponding scanned image. The pixel hits are shown at the bottom of FIG. 3 and represent a summation of the pixel hits. For example, if an image forming device has a fuser roll that is 1' in diameter and you take any point along the circumference of that fuser roll, the number of times that point on the fuser roll touches toner consecutively is considered a hit by the pixel. Accordingly, for a greater number of pixel hits, there becomes a greater and greater risk that the toner will increase the stress transmitted to the fuser roll at that point and eventually cause a problem to that point on the fuser roll. Every time that point on the fuser roll doesn't touch toner, it reduces the frequency of problems the toner roll might get at that point.

According to exemplary embodiments, before a user presents a job request to an image forming system, the user can optionally choose to have the image forming system scan the image(s) to determine characteristics of the image. It should be appreciated that the image(s) could already be scanned and in electronic form and then submitted to the image forming device for analysis. In this way, if the user knows that the image reproduction job has images with high toner coverage in specific areas of the image and a substantial number of copies need to be made, the user can request the analysis of the image(s) to determine if the fuser roll will have enough remaining life to complete the print request. That is, the image forming system can scan the image and provide information that can help predict areas on a fuser roll, which could be subject to high levels of stress. Thus, using the raw image plane information for each pixel, a running histogram for each job(s) can accurately depict that job image stress relationship to the fuser. Accordingly, the information gathered and the analysis performed with respect to the image(s) can be used as a diagnostic tool to help estimate the fuser life and performance ability.

According to exemplary embodiments, the pixel information is first acquired for the image to be reproduced. That is, mathematical formula(s) are incorporated into the control system 400 of the image forming system, discussed further with respect to FIG. 5, for determining how much toner is in a plane that a fuser roller will have the likelihood of hitting. In the example shown in FIG. 3, the pixel location in the fast scan direction is plotted against the scanline in the slow scan direction. Then, histogram values are summed at the bottom of the spreadsheet corresponding to the number of pixel hits shown in the fast scan direction. As a result, based on the histogram values for this particular example, pixel locations 3, 4, 7, 8 & 9 will have higher stress levels transferred to the fuser roll than will pixel locations 1 & 5. Accordingly, exemplary embodiments provide a fuser surface pixel map derived from page image toner coverage. The pixel map can be used to analyze regional stress level transmitted to the fuser. The fuser pixel map is an electronic image map "m" dpi elements wide by "n" dpi elements deep. Wide is defined as the fusers elastomer width. Deep is defined as the fusers elastomer circumference. As previously discussed, high toner densities are viewed to represent high local stresses. Further, repeated exposure of the fuser roll surface to high toner inputs can reduce the life of the fuser roll. Therefore, the information provided regarding the image toner coverage might be useful to a user at the time of preparing an image(s) for reproduction.

FIGS. 4A and 4B show another example of generating pixel data from a scanned image according to exemplary embodiments. As shown in FIG. 4B, examples of sale advertisement images are shown with the corresponding graph showing the pixel location and the percentage of toner hits. As can be seen in FIG. 4A, after the sale advertisement document was scanned and analysis performed, there are areas with both high and relatively low percentages of concentration. Specifically, in the areas having large block letter such as "SALE!" the percentage of toner hits is relatively low in the 60% toner hits range. Conversely, in the areas where it is solid all the way across the document, such as the edge of the border above "2-day CLOSEOUT"; the percentage of toner hits is significantly higher to over 80%. Accordingly, the user is now provided with graphical representation for the degree stress that will be submitted to the fuser roll.

In the above example, the user is provided with valuable information to determine how to proceed with a given image reproduction request. As discussed above, the document has certain areas that might be susceptible to creating areas of high stress on the fuser roll, and thus a higher potential failure rate due to the stress. At this time, the user can determine if they wish to proceed with the printing of the document as is, or if they wish to alter the document to alleviate some of the stress generated by the areas of high toner coverage. The analysis of the image indicates that several lines that are used for borders are the lines that will generate the greatest stress for the fuser. Thus, the user can decide that the border is not necessary to the structure of the document and that it should be removed. Alternatively, the border could be lightened to reduce the toner hits. As a result of removing or lightening a line or border that is immaterial, the life of the fuser roll can be extended. Additionally, the costs associated with reproducing the image(s) can be reduced.

As previously discussed, the user can also be for example, a service representative, a technician, an engineer, etc. Accordingly, the analysis can be requested by a technician in his testing of fuser life as it relates to images and toner. Further, a service representative can have the image forming device generate the information about the image(s) which will allow the representative to analyze the information and provide a customer with recommendations with respect to high stress areas and potential problems that might be created by reproducing certain image(s). That is, the programs and software according to various exemplary embodiments can predict that if you reproduce a certain image a certain number of times, you run a higher degree of risk of failure for that certain type of document. So, if the customer inquiring about potential problems typically changes their fuser roll every 2000 prints, the representative can inform the customer that various parts of the image are going to generate a very high degree of percentage of toner hits and that the fuser roll life expectancy will be shortened. Accordingly, the representative can advise checking the fuser roll at 250 prints rather than 2000 prints, in order to get preventive maintenance. In this exemplary example, the representative is provided with the ability to help a customer diagnose potential problems sooner than before and allow the customer to take actions as countermeasures if desired, and save reproduction time and costs.

Figure 5:
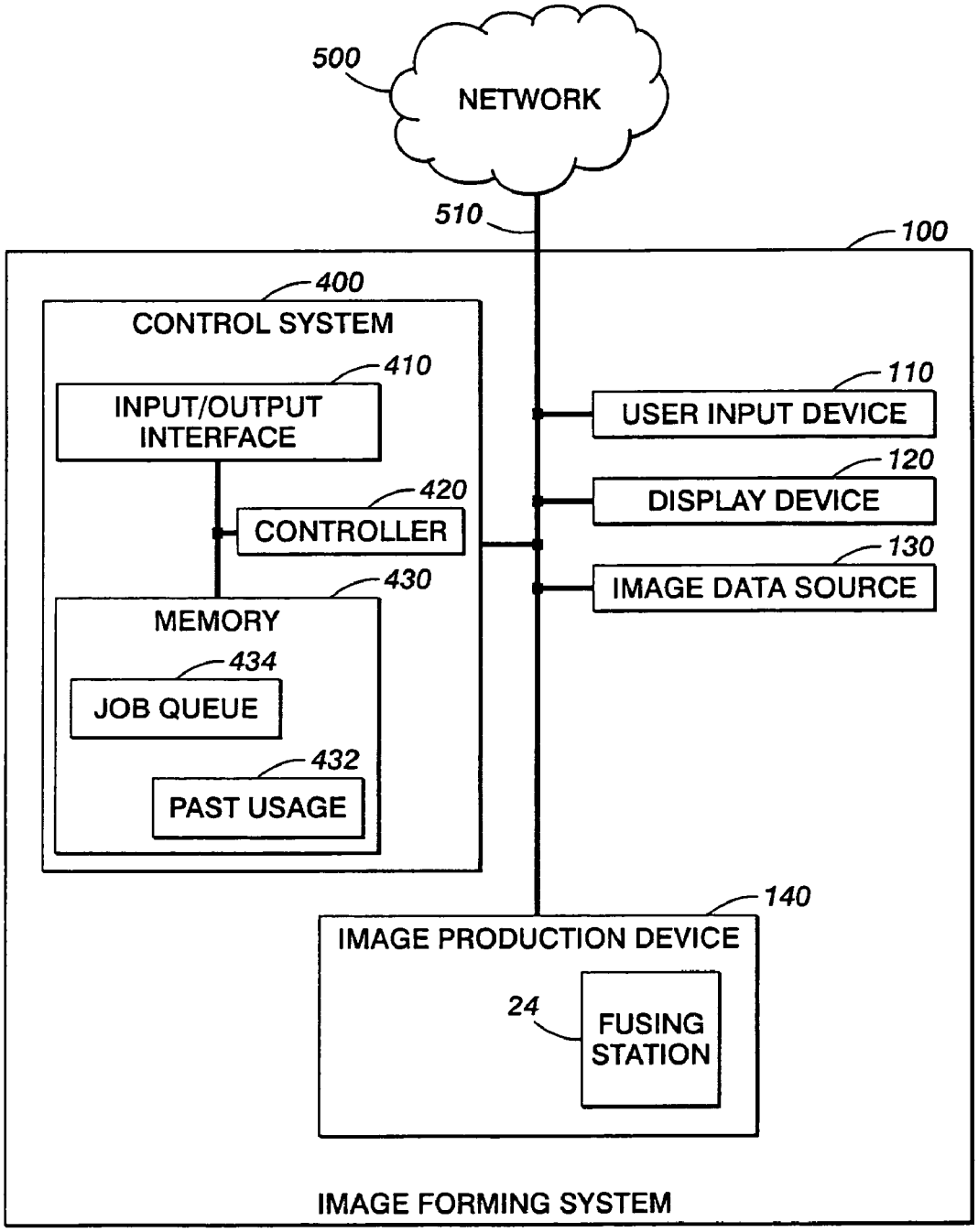
FIG. 5 is a schematic block diagram of the control system of FIG. 1 according to exemplary embodiments.

FIG. 5 shows an image forming system 100 according to exemplary embodiments. As shown in FIG. 5, the image forming system 100 includes an image control system 400, one or more user input devices 110, a display device 120, an image data source 130, and an image production device 140. The image-forming device 100 is also connected to a network 500 over a link 510. The image production device 140 contains elements of the image forming system such as the fuser 26. The fuser 26 is gradually used as the image forming system 100 forms images on recording sheets according to various image production jobs.

The user input devices 110 can be one or more of any known or later-developed input device usable by the user to input data and/or commands to the image-forming device. It should also be appreciated that one or more of the one or more user input devices can be combined with the display device, such as in a touch-screen. The image data source 130 can be any one of a number of different sources, such as a scanner, a digital copier, a facsimile device that is suitable for generating electronic image data, or a device suitable for storing and/or transmitting electronic image data, such as a client server or a network, or the Internet, and especially the World Wide Web. For example, the image data source 130 may be a scanner, or a data carrier such as a magnetic storage disk, CD-ROM or the like, or a host computer, that contains scanned image data. Thus, the image data source 130 can be any known or later developed source that is capable of providing image data to the image forming system 100 of exemplary embodiments. It should also be appreciated that, in various exemplary embodiments, the image data source 130 can be omitted from the image forming system 100.

The control system 400 receives jobs to be reproduced, either over the network 500 or using the image data source 130. Each job indicates such things as the particular document, file or image to be formed and the number of copies to be formed. The control system 400 can be implemented as software executing on a programmed general purpose computer, a special purpose computer, a microprocessor or the like. In this case, the control system 400 can be implemented as a routine embedded in a printer driver, as a resource residing on a server, or the like. The control system 400 can also be implemented by physically incorporating it into a software and/or hardware system, such as the hardware and software systems of a printer or a digital photocopier. Accordingly, the control system 400 can analyze the characteristics of an image to be reproduced. Further, the control system 400 and the associated software can generate the diagrams as shown in FIGS. 3 and 4 and at least one of store, transmit, and display the diagrams. For example, the diagrams can be displayed on the display device 120. Accordingly, the control system 400 can analyze images and determine the high stress areas of the fuser roll to aid in determining the life expectancy of the fuser roll given the requested job.

The control system 400 includes a input/output interface 410, a controller 420, and a memory 430. The memory 430 may include a past usage memory portion 432 and a job queue portion 434. The image data source 130 passes a job to the input/output interface 410. The input/output interface 410 passes the job to the controller 420. The controller 420 stores the job in the job queue portion 434 of the memory 430. As such, the controller 420 and thus, the control system 400, serve to send and receive information from the image production device 140.

As indicated above, various sensors provided in the image production device 140 can be used indicate the expected life of the fuser given the diagnosis of the image to be produced. This information is provided to the control system 400. Accordingly, the control system 400 can determine the useful life of the fuser 26 by sensing the information associated with that fuser 26. That is, if the control system 400 determines that fuser 26 has an adequate amount of useful life to complete a particular job, then the user can be informed that the requested job can proceed as requested.

Alternatively, the controller 420 can store past usage information regarding the use of the fuser 26 that indicates for example, the remaining amount of useful life of the fuser. This information can be transferred to and stored in the past usage memory portion 432. After scanning and analysis, if a requested job is similar to those previously performed, the past usage memory portion 432 can use the information to determine the remaining useful life of the fuser.

As discussed previously, if the control system 400 determines that the fuser 26 does not have enough useful life to complete the requested job, then the control system 400 can generate a warning message to alert the user that requested job couldn't be currently completed. The control system 400 can display a warning message or alert on the display device 120 identifying the problem. The warning message or alert can be any method of alerting the user, such as a warning icon, a flashing light and/or an audible noise. Any other known or later-developed warning techniques or methods are possible without departing from the spirit and scope of exemplary embodiments. Additionally, the control system 400 can display on the display device 120 and image of the scanned document showing a preview of the scanned image and the corresponding potential problem areas. For example, the scanned image can have arrows or dots or highlighted areas indicating which parts of the image are the ones having the high toner coverage and will potentially transmit the greatest stress to the fuser roll. As discussed with respect to FIG. 4, the display device 120 can direct the users attention to the area above "2-day CLOSEOUT" to indicate that this is where a high toner coverage area exists. This will provide the user with immediate and visual analysis of the problem areas allowing the user to quickly decide any potential actions to take.

Figure 6:
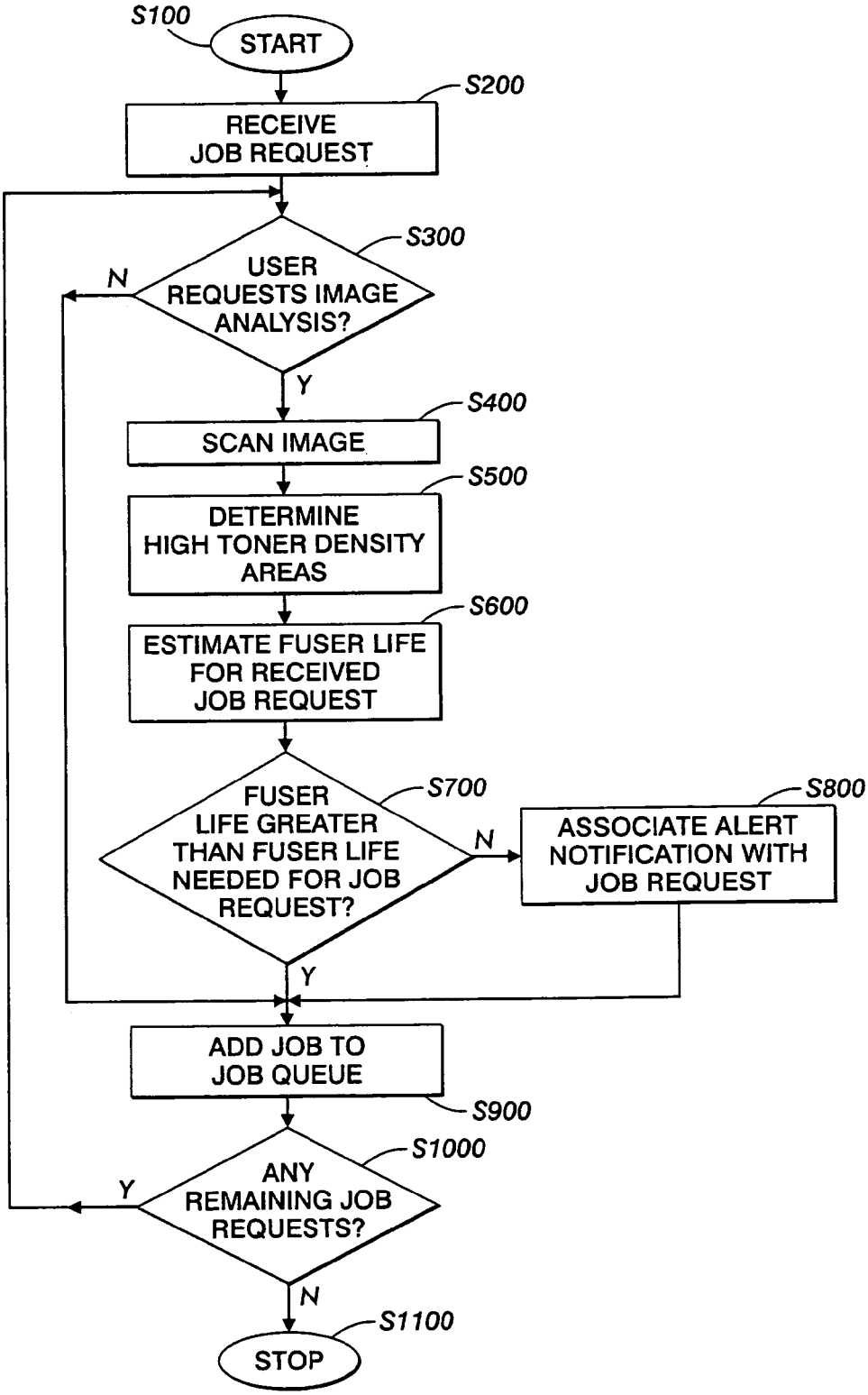
FIG. 6 is a flowchart outlining one exemplary embodiment of a method for determining if a job request can be completed according to exemplary embodiments.

FIG. 6 shows a flowchart outlining one exemplary embodiment of a method for alerting a user concerning the remaining life of a fuser. Operation begins in step S100 and proceeds to step S200 where, a job request is received. In step S300, the user can decide if they would like to have the image(s) scanned for analysis. If the user does not want to have the images(s) scanned, operation proceeds to step S900 where the job request is added to the job queue. If the user wants the images(s) to be scanned, then operation proceeds to S400 where the image(s) are scanned. Next, in step S500, the high toner density areas of the image(s) are determined. Operation then continues to step S600.

In step S600, the amount of the fuser life given the job request, is estimated. Then, in step S700, a determination is made whether the estimated fuser life is greater than the fuser life needed to complete the job request. If the estimated amount of the fuser life is more than the fuser life needed to complete the job request, then operation continues to step S900. Otherwise, operation jumps directly to step S800. In step S800, an alert notification is associated with the received job request. Operation then continues to step S900. In step S900, a determination is made whether there are any remaining job requests. If so, operation returns to step S300. Otherwise, operation continues to step S1000 where the received job is added to the job queue. Operation then continues to step S1100, where the method ends.

While exemplary embodiments have been described, various alternatives, modifications, variations and/or improvements, whether known or that are, or may be, presently unforseen, may become apparent. Accordingly, the exemplary embodiments, as set forth above, are intended to be illustrative, not limiting. Various changes may be made without departing from the spirit and scope of exemplary embodiments. Therefore, the systems and methods according to exemplary embodiments are intended to embrace all now known or later-developed alternatives, modifications, variations and/or improvements.

What is claimed is:

1. An image forming apparatus, comprising:

a memory that stores image information regarding one or more images for at least one current image reproduction job;

a fuser having a useful life;

a controller that determines for the at least one image reproduction job, if that job can be performed based on an estimated remaining useful life of the fuser based on the image information, wherein the controller generates an alert notification if that job can not be completed in view of the estimated remaining useful life of the fuser; and a notification device that conveys an alert notification generated by the controller to a user, wherein the image information includes fuser use information for reproducing the images that includes histogram values summed from a fuser surface pixel map derived from the image information for the current image reproduction job.

2. The apparatus of claim 1, wherein, for each of the at least one job and for the fuser, the controller estimates an amount of remaining useful life of the image reproduction device for that job.

3. The apparatus of claim 2, wherein the notification device indicates that the remaining useful life of the fuser will be inadequate to complete the associated job.

4. The apparatus of claim 1, wherein the notification device is at least one of an alert icon, alert message, flashing light or audible noise.

5. The apparatus of claim 1, wherein, for each job for which the controller has generated an alert notification, the controller prevents the printing of that job.

6. The apparatus of claim 1, further comprising:

a display device, wherein the image information is displayed on the display device.

7. The apparatus of claim 6, wherein the image information includes pixel information regarding at least one of the at least one image.

8. The apparatus of claim 7, wherein the display of the pixel information is one of a graph, chart, a table of data, and a histogram.

9. A method for operating an image forming apparatus having at least one or more images of an image reproduction job to be performed using the image forming apparatus and fuser having a useful life consumed by the image forming apparatus in performing the jobs, the method comprising:

determining image information regarding one or more images for at least one current image reproduction job;

estimating, for the fuser, a remaining useful life of the fuser based on the image information;

determining, for at least one job, and based on the remaining useful life of the fuser, if that job can be performed based on the remaining useful life;

generating, an alert notification if that job can not be completed in view of the remaining useful life; and conveying the alert notification to a user, wherein the image information includes fuser use information for reproducing the images that includes histogram values summed from a fuser surface pixel map derived from the image information for the current image reproduction job.

10. The method of claim 9, wherein estimating the amount needed for that job comprises determining an average amount of the remaining life used in past image forming operations.

11. The method of claim 10, wherein estimating the amount needed for that job further comprises:

determining an approximate number of pages of that job; and multiplying the average per page amount by the approximate number of pages of that job.

12. The method of claim 9, wherein generating the alert notification further comprises associating the alert notification with that job.

13. The method of claim 9, wherein generating the notification alert comprises generating at least one of an alert icon, an alert message, a flashing light or an audible noise.

14. The method of claim 9, further comprising preventing printing of a job if an alert notification has been associated with that job.

15. The method of claim 9, wherein the image information is pixel information regarding the one or more images.

16. The method of claim 15, wherein the image information is at least one of transmitted, stored, and displayed as at least one of a graph, a chart, a table of data, and a histogram.

* * * * *